US007204607B2

(12) United States Patent
Yano et al.

(10) Patent No.: US 7,204,607 B2
(45) Date of Patent: Apr. 17, 2007

(54) LED LAMP

(75) Inventors: Tadashi Yano, Kyoto (JP); Masanori Shimizu, Kyotanabe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 176 days.

(21) Appl. No.: 10/940,860

(22) Filed: Sep. 14, 2004

(65) Prior Publication Data

US 2005/0057929 A1 Mar. 17, 2005

(30) Foreign Application Priority Data

Sep. 16, 2003 (JP) ..... 2003-322645

(51) Int. Cl.
*F21V 9/00* (2006.01)

(52) U.S. Cl. ..... 362/231; 352/235; 352/240

(58) Field of Classification Search ..... 362/240, 362/555, 545, 227, 230, 231, 235, 252, 800, 362/326, 612, 613
See application file for complete search history.

(56) References Cited

U.S. PATENT DOCUMENTS 4,963,798 A * 10/1990 McDermott ..... 362/231
5,865,529 A * 2/1999 Yan ..... 362/327
5,998,925 A 12/1999 Shimizu et al.
6,580,228 B1 * 6/2003 Chen et al. ..... 362/240
6,949,772 B2 * 9/2005 Shimizu et al. ..... 362/249
2003/0189829 A1 10/2003 Shimizu et al.
2004/0100192 A1 5/2004 Yano et al.
2004/0119086 A1 6/2004 Yano et al.
2004/0124430 A1 7/2004 Yano et al.

FOREIGN PATENT DOCUMENTS

JP 10-065221 B2 3/1998
JP 2003-059332 A 2/2003

* cited by examiner

*Primary Examiner*—Sandra O'Shea
*Assistant Examiner*—Bao Q. Truong
(74) *Attorney, Agent, or Firm*—Akin Gump Strauss Hauer & Feld LLP

(57) ABSTRACT

An LED lamp includes: a substrate; a cluster of LEDs, which are arranged two-dimensionally on the substrate; and an interconnection circuit, which is electrically connected to the LEDs. The LEDs include a first group of LEDs, which are located around the outer periphery of the cluster, and a second group of LEDs, which are located elsewhere in the cluster. The interconnection circuit has an interconnection structure for separately supplying drive currents to at least one of the LEDs in the first group and to at least one of the LEDs in the second group separately from each other.

16 Claims, 11 Drawing Sheets

PRIOR ART

LED LAMP

BACKGROUND OF THE INVENTION

1. Field of the Invention

The present invention relates to an LED lamp and more particularly relates to a white LED lamp that can be used as general illumination.

2. Description of the Related Art

A light emitting diode (LED) is a semiconductor device that can radiate an emission in a bright color with high efficiency even though its size is small. The emission of an LED has an excellent monochromatic peak. To obtain white light from LEDs, a conventional LED lamp arranges red, green and blue LEDs close to each other and gets the light rays in those three different colors diffused and mixed together. An LED lamp of this type, however, easily produces color unevenness because the LED of each color has an excellent monochromatic peak. That is to say, unless the light rays emitted from the respective LEDs are mixed together uniformly, color unevenness will be produced inevitably in the resultant white light. Thus, to overcome such a color unevenness problem, an LED lamp for obtaining white light by combining a blue LED and a yellow phosphor was developed (see Japanese Patent Application Laid-Open Publication No. 10-242513 and Japanese Patent No. 2998696, for example).

According to the technique disclosed in Japanese Patent Application Laid-Open Publication No. 10-242513, white light is obtained by combining together the emission of a blue LED and the yellow emission of a yellow phosphor, which is produced when excited by the emission of the blue LED. That is to say, the white light can be obtained by using just one type of LEDs. Accordingly, the color unevenness problem, which arises when white light is produced by arranging multiple types of LEDs close together, is avoidable.

An LED lamp with a bullet-shaped appearance as disclosed in Japanese Patent No. 2998696 may have a configuration such as that illustrated in FIG. 1, for example. As shown in FIG. 1, the LED lamp 200 includes an LED chip 121, a bullet-shaped transparent housing 127 to cover the LED chip 121, and leads 122*a* and 122*b* to supply current to the LED chip 121. A cup reflector 123 for reflecting the emission of the LED chip 121 in the direction indicated by the arrow D is provided for the mount portion of the lead 122*b* on which the LED chip 121 is mounted. The LED chip 121 on the mount portion is encapsulated with a first resin portion 124, in which a phosphor 126 is dispersed and which is further encapsulated with a second resin portion 125. If the LED chip 121 emits a blue light ray, the phosphor 126 converts a portion of the blue light ray into a yellow light ray. As a result, the blue and yellow light rays are mixed together to produce white light.

However, the luminous flux of a single LED is too low. Accordingly, to obtain a luminous flux comparable to that of an incandescent lamp, a fluorescent lamp or any other general illumination used extensively today, an LED lamp preferably includes a plurality of LEDs that are arranged as an array. LED lamps of that type are disclosed in Japanese Patent Application Laid-Open Publications No. 2003-59332 and No. 2003-124528. A relevant prior art is also disclosed in Japanese Patent Application Laid-Open Publication No. 2004-172586.

Japanese Patent Application Laid-Open Publication No. 2004-172586 discloses an LED lamp that can overcome the color unevenness problem of the bullet-type LED lamp disclosed in Japanese Patent No. 2998696. In the bullet-type LED lamp 200 shown in FIG. 1, the first resin portion 124 is formed by filling the cup reflector 123 with a resin to encapsulate the LED chip 121 and then curing the resin. For that reason, the first resin portion 124 easily has a rugged upper surface as shown in FIG. 2. Accordingly, the thickness of the resin including the phosphor 126 loses its uniformity, thus making non-uniform the amounts of the phosphor 126 present along the optical paths E and F of multiple light rays going out of the LED chip 121 through the first resin portion 124. As a result, the unwanted color unevenness is produced.

To overcome such a problem, the LED lamp disclosed in Japanese Patent Application Laid-Open Publication No. 2004-172586 is designed such that the reflective surface of a light reflecting member (i.e., a reflector) is spaced apart from the side surface of a resin portion in which a phosphor is dispersed. FIGS. 3A and 3B are respectively a side cross-sectional view and a plan view illustrating an LED lamp as disclosed in Japanese Patent Application Laid-Open Publication No. 2004-172586. In the LED lamp 300 shown in FIGS. 3A and 3B, an LED (LED bare chip) 112 mounted on a substrate 111 is covered with a resin portion 113 in which a phosphor is dispersed. A reflector 151 with a reflective surface 151*a* is bonded to the substrate 111 such that the reflective surface 151*a* of the reflector 151 is spaced apart from the side surface of the resin portion 113. Thus, the shape of the resin portion 113 can be freely designed without being restricted by the shape of the reflective surface 151*a* of the reflector 151. As a result, the color unevenness can be reduced significantly.

By arranging a plurality of LED lamps having the structure shown in FIGS. 3A and 3B in columns and rows, an LED array such as that shown in FIG. 4 is obtained. In the LED lamp 300 shown in FIG. 4, the resin portions 113, each covering its associated LED chip 112, are arranged in matrix on the substrate 111, and a reflector 151, having a plurality of reflective surfaces 151*a* for the respective resin portions 113, is bonded onto the substrate 111. In such an arrangement, the luminous fluxes of a plurality of LEDs can be combined together. Thus, a luminous flux, comparable to that of an incandescent lamp, a fluorescent lamp or any other general illumination source that is used extensively today, can be obtained easily.

If the LED lamp 300 shown in FIG. 4 is used as general illumination, no color unevenness will be produced and a sufficiently high luminous flux can be obtained. However, the present inventors further analyzed this LED lamp 300 to discover that the LED lamp 300 with such a high luminous flux (which is sometimes called a "high-flux LED lamp") often produces an uncomfortable glaring impression on the viewer although everybody in the prior art has been paying most of their attention to how to increase the luminous flux of the LED lamp. That is to say, as for general illumination, "the brighter, the better" policy is often too simple to work and it is not preferable to make such a glaring impression on the viewer.

According to JIS C8106, the "glare" refers to viewer's uncomfortableness or decreased ability to recognize small objects, or even every object in general, due to an inadequate luminance distribution within his or her vision, which is formed by the excessively high luminance of the luminaire within his or her sight. Generally speaking, the viewer tends to find a light source very glaring (i) if the luminance of the light source exceeds a certain limit, (ii) if the viewer's eyes have got used to the darkness surrounding him or her, (iii) if the source of the glare is too close to his or her eyes, and/or (iv) if the apparent size or the number of the glaring sources is big. Accordingly, it is believed that the viewer is very likely to find an LED lamp glaring if the LED lamp includes a plurality of LEDs, has a high luminance, and is used in a relatively dark place. Among other things, the LED lamp uses the emissions of multiple LEDs and therefore has a much stronger directivity than that of a fluorescent lamp, for example. As a result, the LED lamp tends to produce a stronger glaring impression on the viewer in many cases. Nevertheless, if the luminance of the LED lamp were decreased to reduce such a glare, then the LED lamp would be too dark to use as general illumination. Also, since the degree of that glare changes with the surroundings, there is no need to darken the LED lamp in a situation where the LED lamp should not look glaring. In view of these considerations, if there were an LED lamp that can either take anti-glare measures, or cast bright light as usual, with the glare producing conditions taken into account fully, that would be a very convenient commodity.

SUMMARY OF THE INVENTION

In order to overcome the problems described above, preferred embodiments of the present invention provide an LED lamp that can reduce the glare significantly.

An LED lamp according to a preferred embodiment of the present invention preferably includes: a substrate; a cluster of LEDs, which are arranged two-dimensionally on the substrate; and an interconnection circuit, which is electrically connected to the LEDs. The LEDs preferably include a first group of LEDs, which are located around the outer periphery of the cluster, and a second group of LEDs, which are located elsewhere in the cluster. The interconnection circuit preferably has an interconnection structure for separately supplying drive currents to at least one of the LEDs in the first group and to at least one of the LEDs in the second group separately from each other.

In one preferred embodiment of the present invention, the interconnection circuit preferably has a first interconnection pattern for electrically connecting together at least two of the LEDs in the first group and a second interconnection pattern for electrically connecting together at least two of the LEDs in the second group.

In this particular preferred embodiment, the interconnection circuit is preferably electrically connected to a dimmer. The dimmer preferably has the function of controlling the amounts of light emitted from the first and second groups of LEDs, which are electrically connected to the first and second interconnection patterns, respectively, independently of each other.

In an alternative preferred embodiment, the first interconnection pattern of the interconnection circuit is preferably electrically connected to a dimmer. The dimmer preferably has the function of controlling the amount of light emitted from the first group of LEDs, which are electrically connected to the first interconnection pattern.

In another preferred embodiment, the LED lamp preferably further includes a resistor, which is connected to at least one of the first and second interconnection patterns. The resistor preferably reduces a difference between the amounts of currents flowing through the first and second interconnection patterns.

In still another preferred embodiment, each said LED preferably includes an LED bare chip and a phosphor resin portion that covers the LED bare chip. The phosphor resin portion preferably includes: a phosphor for transforming the emission of the LED bare chip into light having a longer wavelength than the emission; and a resin in which the phosphor is dispersed.

In still another preferred embodiment, the outer periphery is preferably defined along the outermost ones of the LEDs in the first group.

In yet another preferred embodiment, each said LED preferably includes a lens for controlling the spatial distribution of the emission of the LED, and the lens of the LEDs in the second group preferably has a structure that realizes a narrower spatial distribution than the lens of the LEDs in the first group.

In yet another preferred embodiment, the emission of the LEDs in the first group preferably has a lower color temperature than that of the LEDs in the second group.

An LED lamp according to any of various preferred embodiments of the present invention described above can control the amount of light emitted from LEDs located around the outer periphery and the amount of light emitted from LEDs located elsewhere independently of each other. Thus, the luminance of the outer LEDs, which changes the degree of glare significantly, can be controlled selectively. As a result, the glare can be reduced effectively.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 9 is a perspective view schematically illustrating a state where an LED lamp 500, including 16 LEDs 10 arranged as a 4×4 matrix, is turned ON.

DETAILED DESCRIPTION OF PREFERRED EMBODIMENTS

Before preferred embodiments of the present invention are described, examples of LED lamps, each operating by lighting a plurality of LEDs, will be described with reference to FIGS. 5 through 8.

Figure 5:
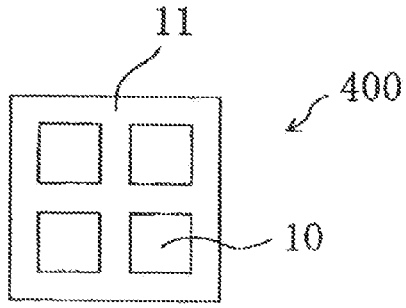
PRIOR ART FIG.5
FIG. 5 is a plan view illustrating an LED lamp 400 in which four LEDs 10 are arranged.
Figure 6A:
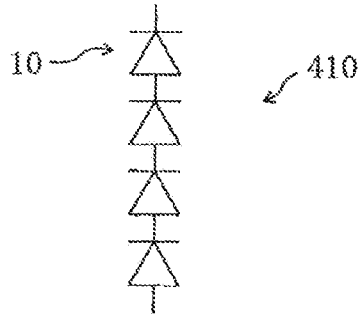
FIG. 6A shows a circuit 410 in which the four LEDs 10 are connected in series together.
Figure 6B:
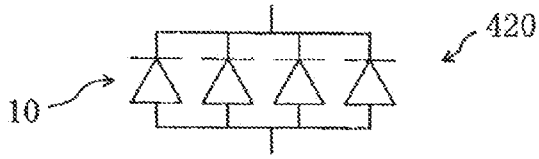
FIG. 6B shows a circuit 420 in which the four LEDs 10 are connected in parallel to each other.

FIG. 5 illustrates an LED lamp 400 in which four LEDs 10 are arranged on a substrate 11. As for the LED lamp 400 shown in FIG. 5, if the four LEDs 10 thereof are connected in series to each other, then the circuit 410 shown in FIG. 6A is obtained. On the other hand, if the four LEDs 10 thereof are connected in parallel to each other, then the circuit 420 shown in FIG. 6B is obtained.

When many LEDs 10 are included in an LED lamp, the serial and parallel connections may be combined together. For example, in an LED lamp in which sixteen LEDs 10 are arranged in a 4×4 matrix, the circuit 430 shown in FIG. 7 may be obtained by connecting together four serial connections of LEDs 10 parallel to each other. Alternatively, the circuit 440 shown in FIG. 8 may also be obtained by connecting together four parallel connections of LEDs 10 in series to each other.

In each of the circuits 400, 410, 420, 430 and 440 described above, the multiple LEDs 10 emit light rays with the same luminous flux. However, even if those LEDs 10 emit the light rays with the same luminous flux, not all of those light rays are directed toward the same object (e.g., a book in a situation where the LED lamp is used as a desk lamp). That is to say, since the light rays diffuse, some of the light rays are directed toward the particular object but others diffuse toward the surroundings.

Figure 8:
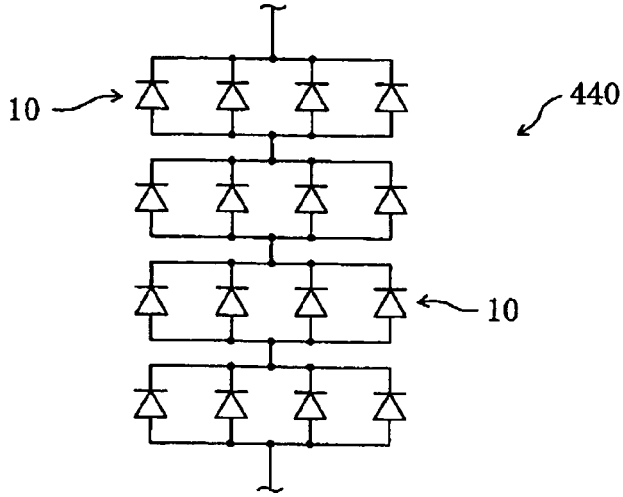
FIG. 8 is a circuit diagram showing a circuit 440 obtained by connecting four parallel connections of the LEDs 10 in series to each other.
Figure 9:
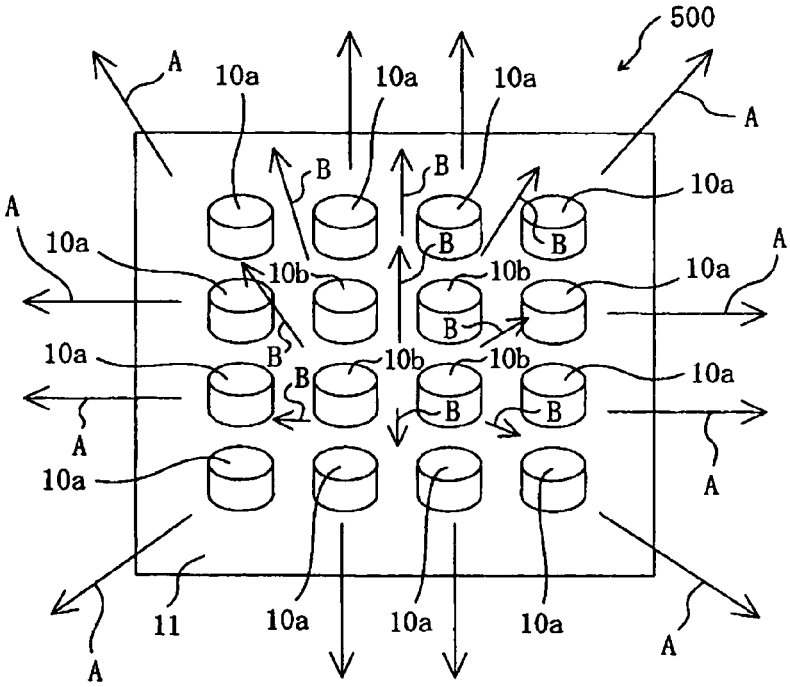

FIG. 9 schematically illustrates a lighted state of an LED lamp 500 in which sixteen LEDs 10 are arranged as a 4×4 array on a substrate 11. In the LED lamp 500, these LEDs 10 may be connected together so as to form either the circuit 430 shown in FIG. 7 or the circuit 440 shown in FIG. 8.

As shown in FIG. 9, the light rays A, which have been radiated from outer LEDs 10*a* among the sixteen LEDs 10 arranged as the 4×4 matrix, tend to diffuse more easily than the light rays B that have been radiated from the other inner LEDs 10*b*. In other words, the light rays B tend to be directed toward the object such as a book easily and can perform the function of illuminating the object fully. Meanwhile, the light rays A might reach the eyes of the viewer who does not like the light's striking his or her eyes. Accordingly, the light rays A, radiated from the outer LEDs 10*a*, are likely to leave the unwanted glaring impression on the viewer.

Figure 7:
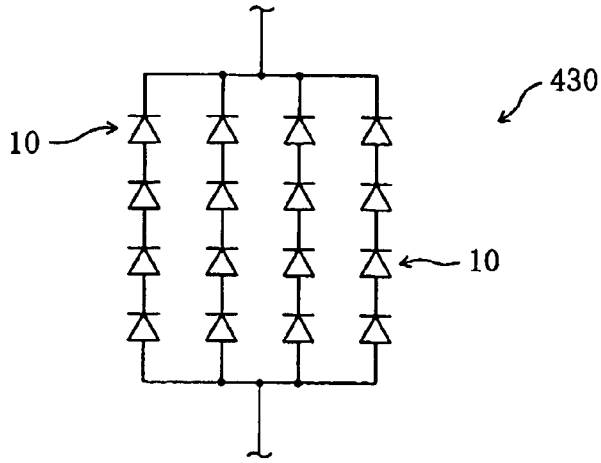
FIG. 7 is a circuit diagram showing a circuit 430 obtained by connecting four serial connections of the LEDs 10 parallel to each other.

To prevent the LED lamp 500 shown in FIG. 9 from producing the glare, not just the luminous flux of the light rays A but also that of the light rays B need to be reduced as well. This is because the LED lamp 500 adopts a circuit configuration that equalizes the luminous fluxes of the respective LEDs 10. That is to say, as long as the circuit configuration shown in FIG. 7 or 8 is adopted, it is impossible to selectively decrease the luminous fluxes of the outer LEDs 10*a* only. However, if the currents supplied to the respective LEDs 10 were all decreased uniformly, then the overall luminous flux of the light striking the object would be too low to use the LED lamp 500 as general illumination.

Thus, the present inventors got the basic idea of the present invention by discovering that the glare should be reduced effectively by providing two separate circuits for the outer LEDs 10*a* and the inner LEDs 10*b*, respectively, and by selectively adjusting the luminance of the outer LEDs 10*a* only.

Hereinafter, preferred embodiments of the present invention will be described with reference to the accompanying drawings, in which any pair of components having substantially the same function and appearing on multiple sheets will be identified by the same reference numeral for the sake of simplicity. It should be noted that the present invention is in no way limited to the following specific preferred embodiments.

Embodiment 1

First, an LED lamp 100 according to a first specific preferred embodiment of the present invention will be described with reference to FIGS. 10 and 11.

Figure 10:
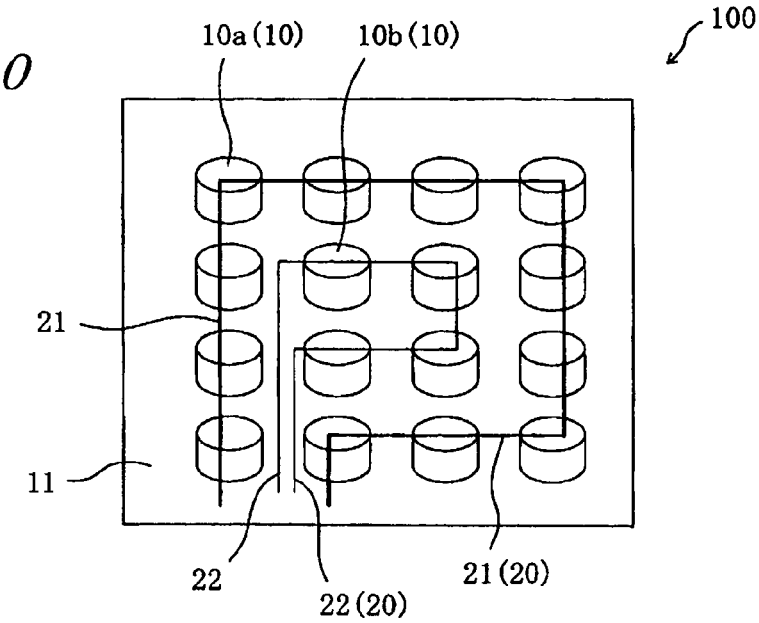
FIG. 10 is a perspective view schematically illustrating an arrangement for an LED lamp 100 according to a first specific preferred embodiment of the present invention.

FIG. 10 schematically shows an arrangement for the LED lamp 100. As shown in FIG. 10, the LED lamp 100 includes a substrate 11, a plurality of LEDs 10 arranged two-dimensionally on the substrate 11, and an interconnection circuit 20 that is electrically connected to the LEDs 10.

The LEDs 10 make up a cluster of LEDs that are densely arranged two-dimensionally. The LEDs 10 included in that LED cluster are roughly classified into the two groups. Specifically, a first group consists of the LEDs 10*a* that are located in the outside portion of the cluster, while a second group consists of the LEDs 10*b* that are located in the inside portion of the cluster.

The interconnection circuit 20 of this preferred embodiment includes a first interconnection pattern 21 and a second interconnection pattern 22, which is provided independently of the first interconnection pattern 21. The first and second interconnection patterns 21 and 22 are provided for the first and second groups of LEDs, respectively. That is to say, the outer LEDs 10*a* are electrically connected to the first interconnection pattern 21, while the inner LEDs 10*b* are electrically connected to the second interconnection pattern 22.

In this preferred embodiment, the LEDs 10*a* located around the outer periphery and the LEDs 10*b* located elsewhere (i.e., in the inside area) are connected to mutually different interconnection patterns 21 and 22, respectively, and therefore, the luminance of the outer LEDs 10*a* can be changed selectively. As a result, the glare can be cut down effectively. For example, if the interconnection circuit 20 is electrically connected to a dimmer (not shown) so as to make the dimmer control the amount of the light emitted from the outer LEDs 10*a*, which are electrically connected to the first interconnection pattern 21, and the amount of the light emitted from the inner LEDs 10*b*, which are electrically connected to the second interconnection pattern 22, independently of each other, then no glare should be produced. Alternatively, instead of connecting both the first and second interconnection patterns 21 and 22 to the dimmer, just the first interconnection pattern 21 may be electrically connected to the dimmer (not shown) so as to control the amount of light emitted from the outer LEDs 10*a*.

Figure 11:
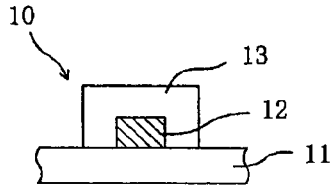
FIG. 11 is a cross-sectional view schematically illustrating a configuration for an LED 10.

FIG. 11 schematically illustrates the cross-sectional structure of an LED 10 according to this preferred embodiment. As shown in FIG. 11, the LED 10 includes an LED bare chip 12 and a phosphor resin portion 13 that covers the LED bare chip 12. The phosphor resin portion 13 includes a phosphor (or luminophor) for transforming the emission of the LED bare chip 12 into light having a longer wavelength than the emission and a resin in which the phosphor is dispersed. The LED bare chip 12 is mounted on the substrate 11, on which the first and second interconnection patterns 21 and 22 shown in FIG. 10 are provided.

The LED bare chip 12 is an LED chip that produces light having a peak wavelength falling within the visible range of 380 nm to 780 nm. The phosphor dispersed in the phosphor resin portion 13 produces an emission that has a different peak wavelength from that of the LED bare chip 12 within the visible range of 380 nm to 780 nm. In this preferred embodiment, the LED bare chip 12 is a blue LED that emits a blue light ray and the phosphor included in the phosphor resin portion 13 is a yellow phosphor that transforms the blue ray into a yellow ray. The blue and yellow rays are mixed together to produce white light.

The LED bare chip 12 is preferably an LED chip made of a gallium nitride (GaN) based material and emits light with a wavelength of 460 nm, for example. For example, if a blue-ray-emitting LED chip is used as the LED bare chip 12, then $(Y.Sm)_3$, $(Al.Ga)_5O_{12}$:Ce or $(Y_{0.39}Gd_{0.57}Ce_{0.03}Sm_{0.01})_3Al_5O_{12}$ may be used effectively as the phosphor. In this preferred embodiment, the phosphor resin portion 13 preferably has a substantially cylindrical shape. If the LED bare chip 12 has approximately 0.3 mm×0.3 mm dimensions, then the phosphor resin portion 13 may have a diameter of about 0.7 mm to about 0.9 mm, for example.

In the configuration shown in FIG. 10, the LEDs 10 are arranged in a 4×4 matrix on the substrate 11. However, the number of the LEDs 10 does not have to be sixteen as shown in FIG. 10 but may be the product of N and M (where N and M are both integers that are equal to or greater than two).

Furthermore, the two-dimensional arrangement of the LEDs 10 is not limited to the matrix arrangement such as that shown in FIG. 10, either, but may also be a substantially concentric arrangement, a spiral arrangement or any other suitable arrangement. In any of those alternative arrangements, at least the amount of the light emitted from the outer LEDs 10*a*, which is a primary cause of the glare, has to be controlled by connecting the LEDs 10*a* to the interconnection pattern 21.

Figure 12:
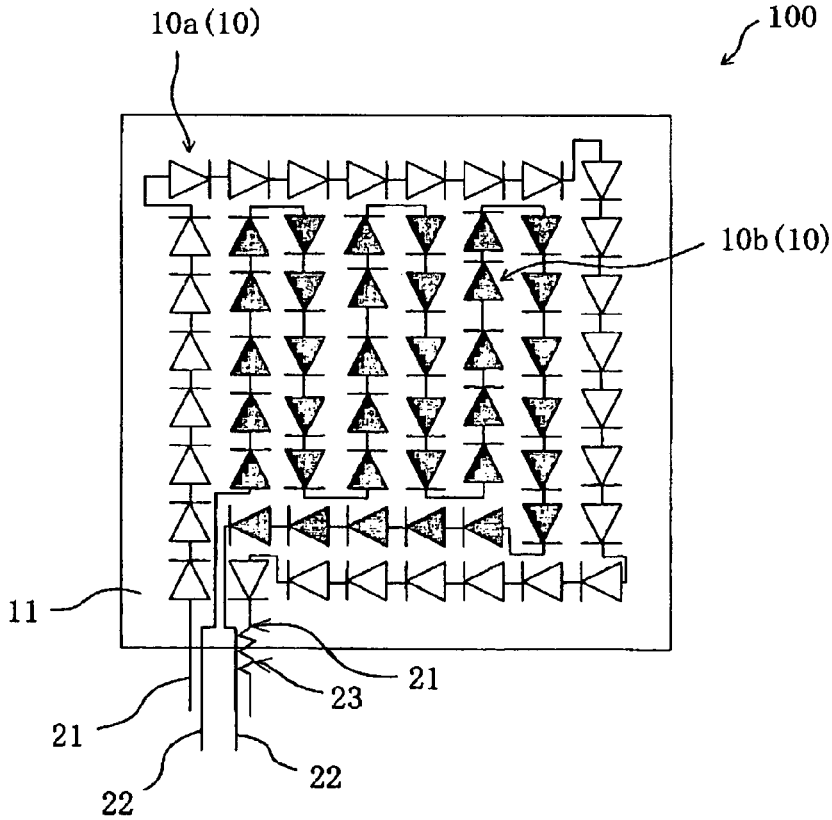
FIG. 12 is a circuit diagram showing a configuration for an LED lamp 100 according to the first preferred embodiment of the present invention.

FIG. 12 shows a circuit configuration for an LED lamp 100 in which sixty-four LEDs 10 are arranged as an 8×8 matrix. The LEDs 10*a* located around the outer periphery are connected to a first interconnection pattern 21, while the other LEDs 10*b* located elsewhere are connected to a second interconnection pattern 22.

In the example illustrated in FIG. 12, the number of the outer LEDs 10*a* is different from that of the inner LEDs 10*b*, and therefore, a resistor 23 is additionally provided for the second interconnection pattern 22 in order to substantially equalize the amounts of currents flowing through the first and second interconnection patterns 21 and 22 with each other.

Figure 13:
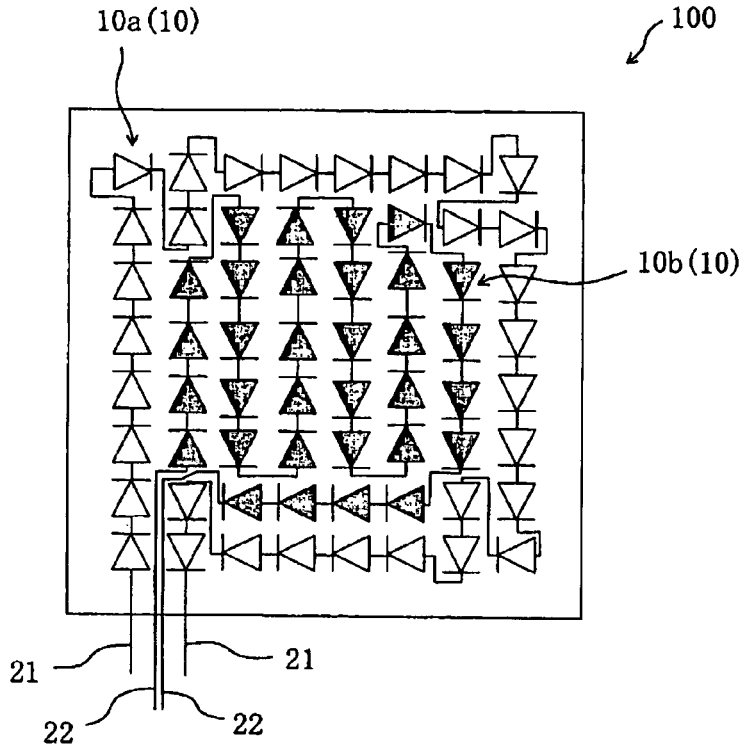
FIG. 13 is a circuit diagram showing a configuration for another LED lamp 100 according to the first preferred embodiment of the present invention.

Alternatively, the number of the outer LEDs 10*a* may be equalized with that of the inner LEDs 10*b* as shown in FIG. 13. In that case, the amounts of currents flowing through the first and second interconnection patterns 21 and 22 are typically equal to each other, and there is almost no need to provide the resistor 23 such as that shown in FIG. 12.

Figure 14:
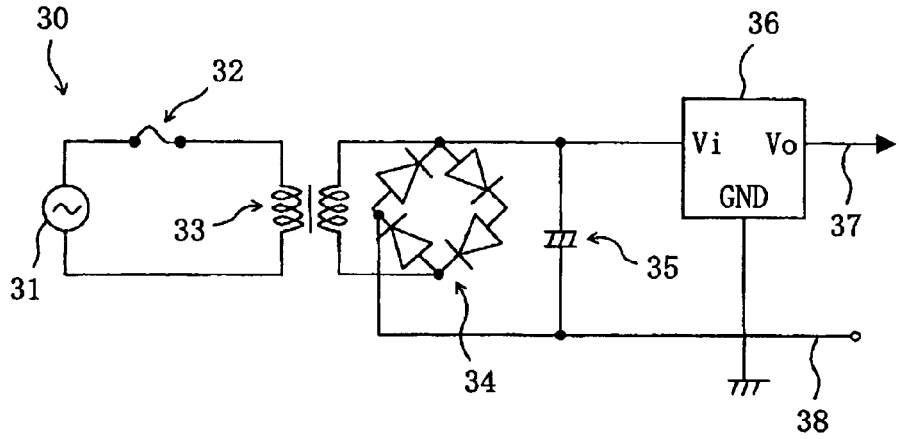
FIG. 14 is a circuit diagram showing a configuration for a dimmer 30.

FIG. 14 shows an exemplary dimmer 30 to be electrically connected to the first interconnection pattern 21. The dimmer 30 shown in FIG. 14 has its circuit configuration designed such that an AC voltage supplied from an AC outlet 31 (e.g., an AC voltage of 100 V) is rectified and converted into a DC voltage and then the power is controlled with a regulator 36. As shown in FIG. 14, the dimmer 30 includes a fuse 32, a power transformer 33, a diode bridge 34, a smoothing capacitor 35 and the regulator 36. The terminal 37 outputs a DC voltage (positive) and the terminal 38 has a ground potential.

In a preferred embodiment of the present invention, the terminals 37 and 38 are preferably connected to the first interconnection pattern 21. For example, the positive and negative terminals of the first interconnection pattern 21 shown in FIG. 12 or 13 may be respectively connected to the terminals 37 and 38 of the dimmer 30. The regulator 36 preferably controls the amount of the current to be supplied to the outer LEDs 10*a*, which are connected to the first interconnection pattern 21, thereby controlling the amount of the light emitted from those outer LEDs 10*a*.

Optionally, two dimmers 20 may be provided and connected to the first and second interconnection patterns 21 and 22, respectively. In that case, the amounts of light emitted from the two groups of LEDs 10*a* and 10*b* can be controlled independently of each other. It should be noted that the dimmer(s) for controlling the amount(s) of light emitted from the LEDs 10*a* (and 10*b*) does not have to have the configuration shown in FIG. 14 but may have any other suitable configuration.

Even if the LED lamp 100 of this preferred embodiment is making a glaring impression on the viewer, that glare can be erased quickly by getting the amount of the light emitted from the outer LEDs 10*a* controlled by the dimmer 30. In that case, the amount of the light emitted from the inner LEDs 10*b* can be kept as it is. Thus, the glare can be reduced without decreasing the overall luminous flux of the LED lamp 100.

In addition, the light emitted from the inner LEDs 10*b* illuminates the object exclusively. As used herein, the "object" may refer to a book, for example, when the LED lamp 100 is used as a desk or bedside lamp. Accordingly, even if the luminous flux of the LED lamp 100 decreased significantly, there might still be no problem as long as the user can view the object (e.g., read that book) satisfactorily. For example, if a lens structure that realizes a sufficiently narrow spatial distribution of emission is provided in front of the inner LEDs 10*b*, most of the light illuminating the object comes from the inner LEDs 10*b*. Accordingly, the amount of the light illuminating the object can be kept substantially constant even when the amount of light coming from the outer LEDs 10*a* is controlled.

Optionally, instead of using the dimmer 30, a switching mechanism for selectively turning the LEDs 10*a* ON and OFF may also be adopted. Then, the object can be illuminated with the light cast from the LEDs 10*b* with the glare reduced by turning the LEDs 10*a* OFF.

It should be noted that if the user of the LED lamp 100 feels uncomfortable about the state in which only the outer LEDs 10*a* are darkened or turned OFF, then a mechanism for controlling the brightness ratio between the outer and inner LEDs 10*a* and 10*b* either automatically or manually may be adopted and used for erasing such uncomfortableness.

Figure 1:
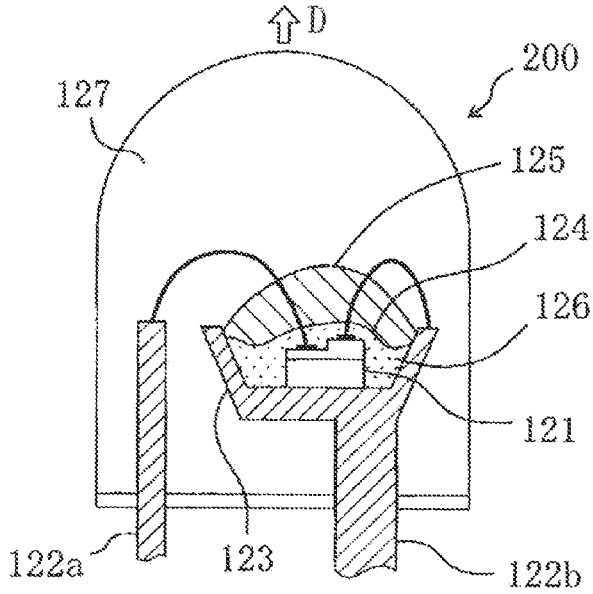
FIG. 1 is a cross-sectional view schematically illustrating a configuration for an LED lamp with a bullet shaped appearance as disclosed in Japanese Patent No. 2998696.
Figure 2:
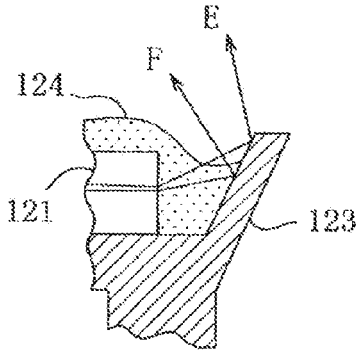
PRIOR ART FIG. 2
FIG. 2 is an enlarged cross-sectional view illustrating a main portion of the LED lamp shown in FIG. 1.
Figure 3A:
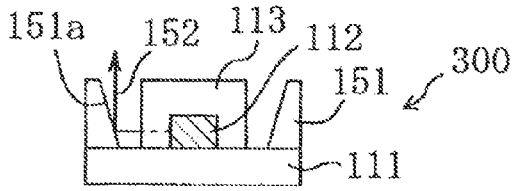
PRIOR ART FIG. 3A
FIGS. 3A and 3B are respectively a side cross-sectional view and a plan view illustrating an LED lamp as disclosed in Japanese Patent Application Laid-Open Publication No. 2004-172586.
Figure 3B:
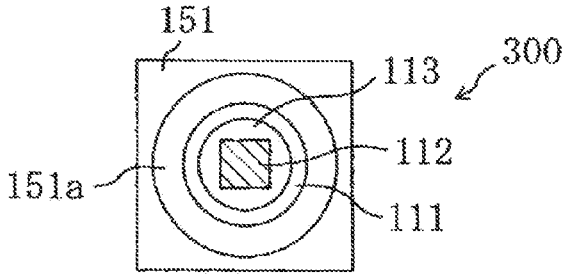
PRIOR ART FIG. 3B
Figure 4:
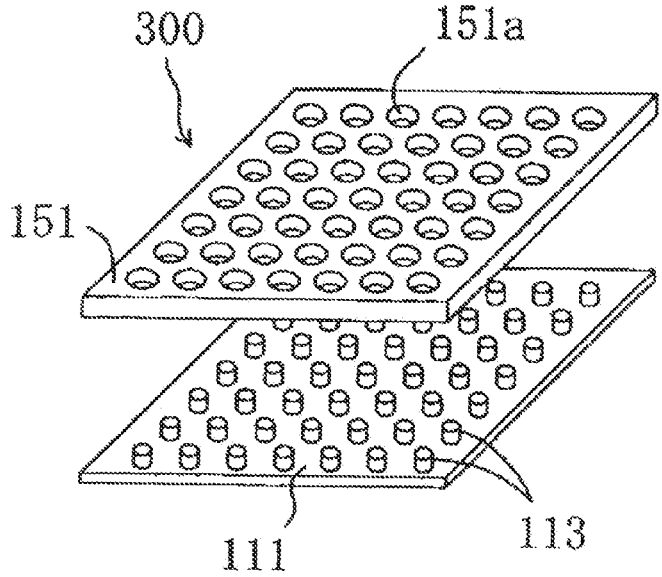
FIG. 4 is a perspective view illustrating an exemplary configuration in which the LED lamps shown in FIGS. 3A and 3B are arranged in matrix.
Figure 15:
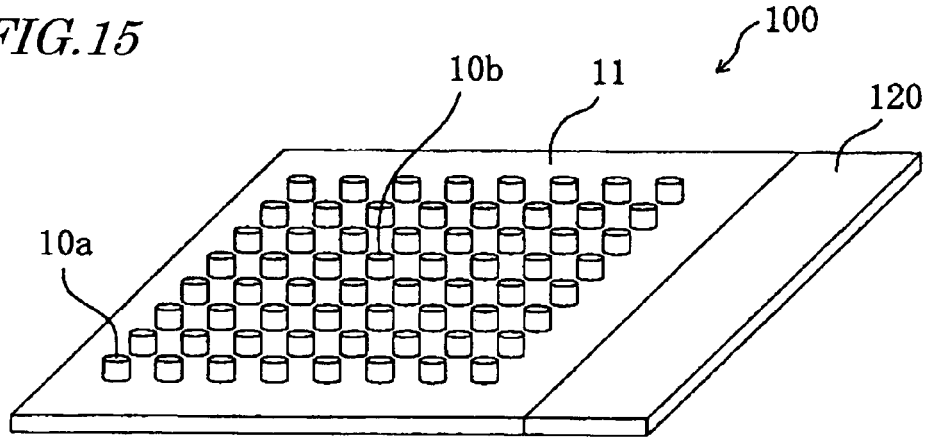
FIG. 15 is a perspective view schematically illustrating a configuration for a card LED lamp 100 according to the first preferred embodiment of the present invention.

The LED lamp 100 of this preferred embodiment may also be implemented as a card LED lamp such as that shown in FIG. 15. In the card LED lamp 100 shown in FIG. 15, the substrate 11 includes a feeder section 120, which is electrically connected to the LEDs 10 by way of the first and second interconnection patterns 21 and 22 embedded in the substrate 11. The detailed configuration of the feeder section 120 is not shown in FIG. 15. Optionally, a feeder terminal may be provided on the surface of the feeder section 120. When the card LED lamp shown in FIG. 15 is actually used, a metallic reflector with multiple openings to accommodate the respective LEDs 10 (see the reflector 151 shown in FIG. 4) is preferably put on the substrate 11. It should be noted that the substrate 11 and the reflector (151) may be collectively called the "substrate" of the LED lamp 100. Alternatively, if the surface of the substrate 11 is turned into a reflective surface, then the substrate 11 itself may be used as an optical reflective member.

Figure 16:
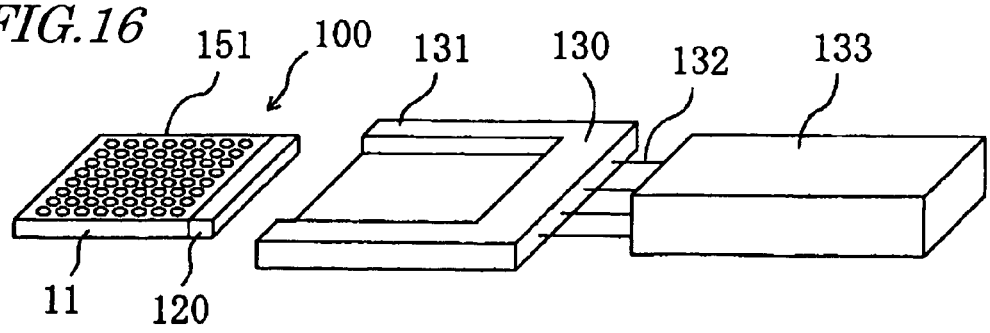
FIG. 16 is a perspective view illustrating how the card LED lamp 100 may be used.

This card LED lamp 100 may be used as shown in FIG. 16. FIG. 16 shows the LED lamp 100 obtained by bonding the reflector 151 to the substrate 11, a connector 130 to/from which the LED lamp 100 is attachable and removable freely, and a lighting circuit 133 to be electrically connected to the LED lamp 100 by way of the connector 130. The lighting circuit 133 preferably has the function of controlling either the amount of the light emitted from the outer LEDs 10*a* only or the amounts of the light emitted from the outer and inner LEDs 10*a* and 10*b* independently of (or in cooperation with) each other. The LED lamp 100 is inserted into the connector 130 that has a pair of guide grooves 131. The connector 130 includes a feeder electrode (not shown) to be electrically connected to the feeder electrode (not shown, either) that is provided on the feeder section 120 of the LED lamp 100. The feeder electrode of the connector 130 is electrically connected to the lighting circuit 133 by way of lines 132.

Figure 17:
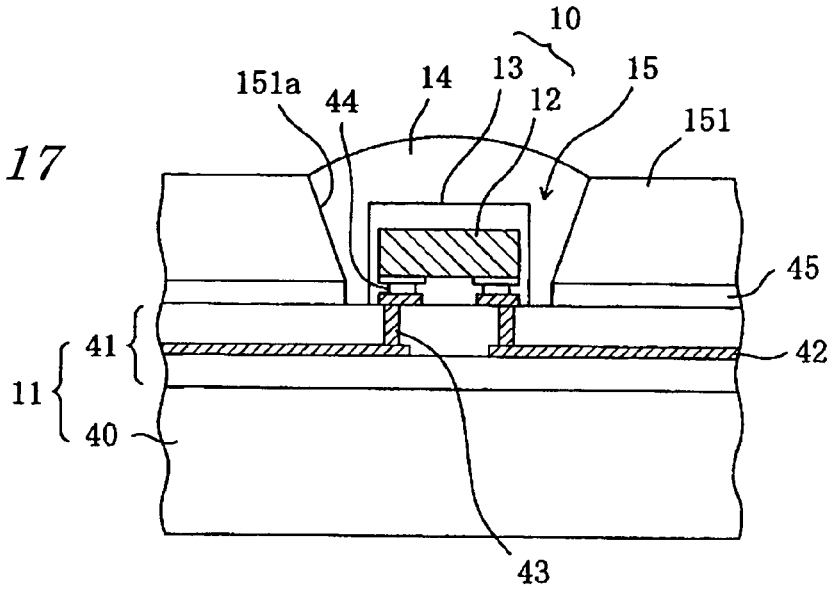
FIG. 17 is a cross-sectional view illustrating an LED 10 and its surrounding portions in an LED lamp 100 including a reflector 151.

FIG. 17 is a cross-sectional view illustrating a portion of the LED lamp 100 with the reflector 151, surrounding the LED 10, on a larger scale. In FIG. 17, the LED bare chip 12 is flip-chip bonded to an interconnection pattern 42 of a multilayer wiring board 41, which is attached to the metal plate 40. In this case, the metal plate 40 and the multilayer wiring board 41 together make up the substrate 11. The LED bare chip 12 is covered with the phosphor resin portion 13. And the phosphor resin portion 13 is further covered with a lens 14, which may be made of a resin, for example.

In this preferred embodiment, the multilayer wiring board 41 includes a two-layered interconnection pattern 42, in which interconnects belonging to the two different layers are connected together by way of via metals 43. Specifically, the interconnects 42 belonging to the upper layer are connected to the electrodes of the LED chip 12 via Au bumps 44. In the example illustrated in FIG. 17, an underfill (stress relaxing) layer 45 is preferably provided between the reflector 151 and the multilayer wiring board 41. This underfill layer 45 can not only relax the stress, resulting from the difference in thermal expansion coefficient between the metallic reflector 151 and the multilayer wiring board 42, but also ensure electrical insulation between the reflector 151 and the upper-level interconnects of the multilayer wiring board 41.

The reflector 151 has an opening 15 to accommodate the phosphor resin portion 13 that covers the LED bare chip 12. The side surface defining the opening 15 is used as a reflective surface 151*a* for reflecting the light that has been emitted from the LED 10. In this case, the reflective surface 151*a* is spaced apart from the side surface of the phosphor resin portion 13 such that the shape of the phosphor resin portion 13 is not affected by the reflective surface 151*a* so much as to produce color unevenness. The specifics and effects of this spacing arrangement are described in Japanese Patent Application Laid-Open Publication No. 2004-172586, the entire contents of which are hereby incorporated by reference.

FIGS. 10 and 15 show substantially cylindrical phosphor resin portions 13. As used herein, the "substantially cylindrical" shape may refer to not only a completely circular cross section but also a polygonal cross section with at least six vertices. This is because a polygon with at least six vertices substantially has axial symmetry and can be virtually identified with a "circle". By using a phosphor resin portion 13 with such a substantially cylindrical shape, even if the LED bare chip 12 being ultrasonic flip-chip bonded to the substrate 11 rotated due to the ultrasonic vibrations applied thereto, the luminous intensity distribution of the LED would not be affected so easily.

Figure 18:
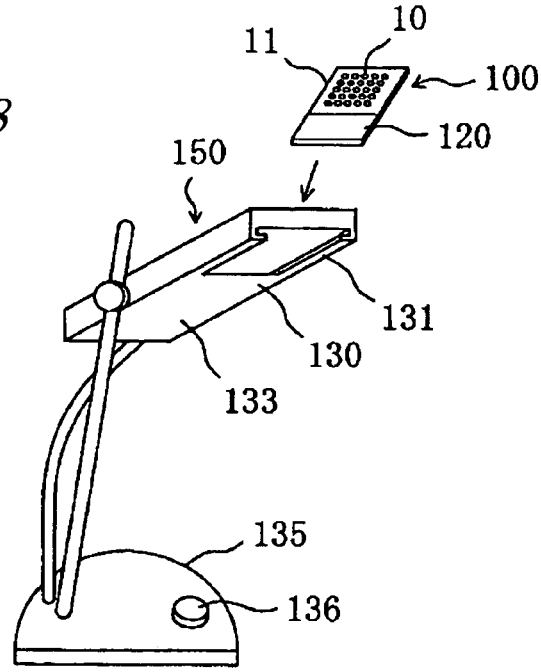
FIG. 18 is a perspective view schematically illustrating a configuration for a desk lamp 150.
Figure 19:
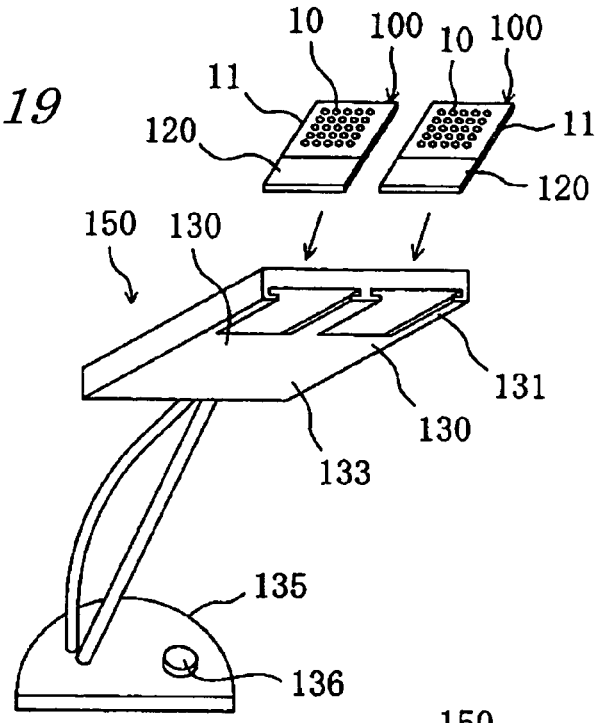
FIG. 19 is a perspective view schematically illustrating a configuration for another desk lamp 150.
Figure 20:
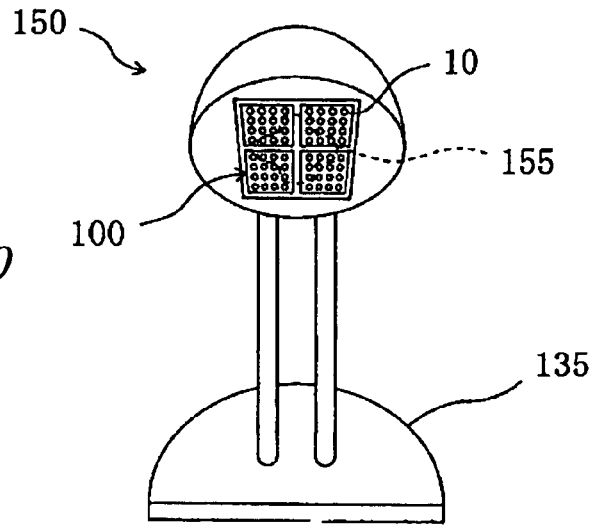
FIG. 20 is a perspective view schematically illustrating a configuration for still another desk lamp 150.
Figure 21:
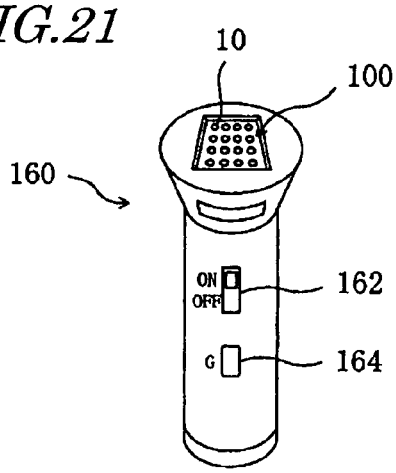
FIG. 21 is a perspective view schematically illustrating a configuration for a flashlight 160.

The LED lamp 100 of this preferred embodiment is easily applicable to a desk or bedside lamp or to a flashlight. FIGS. 18, 19 and 20 show exemplary applications of the card LED lamp 100 to desk lamps 150. FIG. 21 shows an exemplary application of the card LED lamp 100 to a flashlight 160.

The desk lamp 150 shown in FIG. 18 is designed so as to illuminate the object by using just one card LED lamp 100. When the card LED lamp 100 is inserted into the connector 130, the amount of the light emitted from the outer LEDs 10*a* can be controlled as described above. In the example illustrated in FIG. 18, the base 135 of the desk lamp 150 includes a controller dial (anti-glare dial) 136 such that the glare can be cut down by adjusting the dial 136. However, even if the amount of the light emitted from the outer LEDs 10*a* has been decreased by turning the dial 136, just the amount of unwanted diffusing light can be reduced and the object (e.g., a book) can still be illuminated with a sufficient amount of light coming from the inner LEDs 10*b*.

The LED lamp 100 of this preferred embodiment does not always have to be used by itself but may be used with at least another in combination. FIG. 19 schematically illustrates a configuration for a desk lamp 150 that uses two card LED lamps 100 at the same time. The desk lamps shown in FIGS. 18 and 19 use the card LED lamps 100. However, the LED lamps 100 do not have to be the card type. Even if the desk lamps are operated using non-removable LED lamps 100, the glare can still be reduced effectively.

FIG. 20 shows a configuration for a desk lamp 150 that uses four LED lamps 100 at the same time. When four LED lamps 100 are used at a time, some of the LEDs 10*a*, which are located around the outer periphery in each LED lamp 100, become inner LEDs 10*b*. In the example illustrated in FIG. 20, the LEDs 10 located within the area 155 may be used as additional inner LEDs. Thus, the LEDs 10 located within this area 155 may be designed just like the inner LEDs 10*b*. Alternatively, to mass-produce and use the LED lamps 100 of the same type in quantities, even the LEDs 10 within the area 155 may be used as outer LEDs 10*a* as they are.

As for the desk lamp 150 shown in FIG. 20, the anti-glare effects are also achieved no matter whether the card LED lamps 100 are used or not. That is to say, it does not matter whether the LED lamps 100 are removable or not.

FIG. 21 shows a configuration for a flashlight 160 that uses the LED lamp 100. The flashlight 160 shown in FIG. 21 includes not only a normal switch 162 for turning this flashlight ON or OFF but also an anti-glare switch 164 as well. Specifically, when the anti-glare switch 164 is pressed down, the light emitted from the outer LEDs 10*a* is either decreased or put out, thereby preventing the flashlight 160 from producing the glaring impression. For example, the flashlight 160 may be used in a normal mode to illuminate a broad range but is preferably switched into the anti-glare mode in order to prevent this flashlight 160 from leaving the glaring impression on the people surrounding it.

In the LED lamp 100 of this preferred embodiment, the amount of the light emitted from the outer LEDs 10*a*, which changes the degree of the glare, can be controlled selectively among the two-dimensional arrangement of LEDs 10, and therefore, the glare can be reduced effectively. As a result, the present invention contributes to further popularizing LED lamps as general illumination units.

In the preferred embodiment described above, the outer LEDs 10*a* are supposed to be outermost ones as shown in FIGS. 10 and 12. However, as shown in FIG. 13, even non-outermost LEDs 10 may also be used as the outer LEDs 10*a*, too.

As another alternative, to further enhance the anti-glare effects, the outermost and second outermost LEDs 10 may be used as the outer LEDs 10*a* in the arrangement shown in FIG. 12, for example.

Also, in the preferred embodiment described above, the white LED lamp 100, including a plurality of LEDs 10 each made up of a blue LED chip 12 and a yellow phosphor, has been described. However, a white LED lamp, which produces white light by combining an ultraviolet LED chip, emitting an ultraviolet ray, with a phosphor that produces red (R), green (G) and blue (B) rays when excited with the ultraviolet ray, was also developed recently. Thus, the LED lamp 100 may also be of that type. The ultraviolet LED chip emits an ultraviolet ray with a peak wavelength of 200 nm to 410 nm. The phosphor producing red (R), green (G) and blue (B) rays has peak wavelengths of 450 nm, 540 nm and 610 nm within the visible range of 380 nm to 780 nm.

Furthermore, in the preferred embodiment described above, the LED 10 is supposed to include the LED bare chip 12. However, the LED does not always have to include a LED bare chip. Rather, the same anti-glare effects are achievable by applying the present invention to any other type of LED lamp as long as the outer LEDs of the LED lamp might produce the glaring impression. For example, the anti-glare effects are also achievable in not just the white LED lamp of the preferred embodiment described above but also a single-color LED lamp emitting an R, G or B ray. Also, as long as the LED lamp (or LED module) includes at least four LEDs 10, the LEDs 10 can be grouped into the outer LEDs 10*a* and inner LEDs 10*b*.

Embodiment 2

Hereinafter, an LED lamp according to a second specific preferred embodiment of the present invention will be described.

In the LED lamp 100 of the first preferred embodiment described above, the amount of the light emitted from the outer LEDs 10*a* is controlled appropriately, thereby reducing the glare effectively. In this preferred embodiment, an arrangement for further reducing the glare is adopted.

Figure 22A:
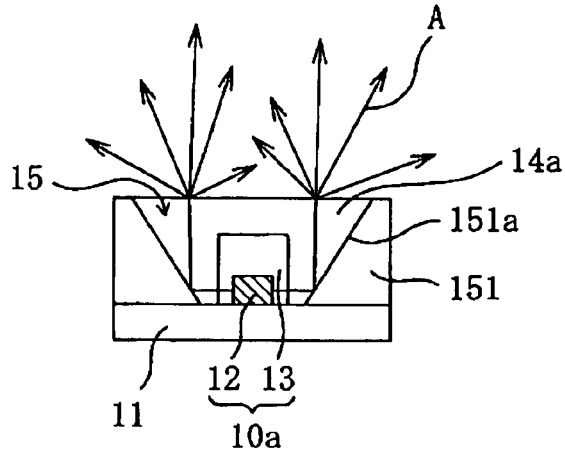
FIGS. 22A and 22B are enlarged cross-sectional views illustrating two main portions of an LED lamp according to a second specific preferred embodiment of the present invention.
Figure 22B:
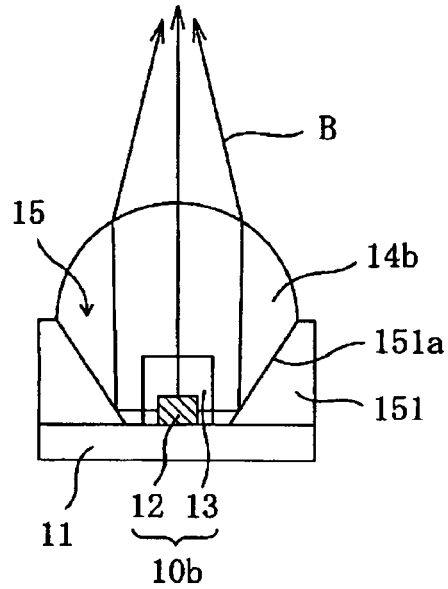

FIGS. 22A and 22B schematically illustrate a configuration for a lens 14*a* that covers the outer LED 10*a* and a configuration for a lens 14*b* that covers the inner LED 10*b*, respectively. As shown in FIGS. 22A and 22B, in this preferred embodiment, the inner lens 14*b* has a lens structure that forms a narrower luminous intensity distribution than the outer lens 14*a* does. By adopting such an arrangement, even if the amount of the light emitted from the outer LEDs 10*a* has been decreased, it is harder for the light emitted from the inner LEDs 10*b* to diffuse outward due to the action of the lenses 14*b*. As a result, the glare can be reduced even more effectively. To make the inner lenses 14*b* form such a narrow luminous intensity distribution, the inner lenses 14*b* may have a hemispherical convex shape and a half beam angle of 35 degrees or less, for example.

Light in a color with a relatively low color temperature (e.g., a bulb color) tends to produce a lighter glaring impression on the human eyes than light in a color with a relatively high color temperature (e.g., a substantially daylight color including a daylight color and neutral white). For that reason, it is also an effective measure to take to set the color temperature of the light emitted from the outer LEDs 10*a* lower than that of the light emitted from the inner LEDs 10*b*. To make such color temperature settings, one of the following techniques may be adopted.

One technique is to set the volume of the outer phosphor resin portion 13 greater than that of the inner phosphor resin portion 13. Then, the light emitted from the LED bare chip 12 in the outer LED 10*a* has to go through a greater amount of phosphor. Accordingly, the outgoing light of the outer LED 10*a* becomes closer to bulb color and comes to have a lower color temperature.

Another technique is to set the concentration of the phosphor in the outer phosphor resin portion 13 higher than that of the phosphor in the inner phosphor resin portion 13. Then, the light emitted from the LED bare chip 12 in the outer LED 10*a* has to go through a greater amount of phosphor. Accordingly, the outgoing light of the outer LED 10*a* also becomes closer to bulb color and comes to have a lower color temperature, too. The color temperatures of the outgoing light of the inner and outer LEDs may also be adjusted by changing the types or the mixture ratio of the phosphors for the inner and outer phosphor resin portions 13.

In fabricating the LED lamp 100 such as that shown in FIG. 15, it is convenient to adopt a method of forming the multiple phosphor resin portions 13 in the same process step (i.e., at the same time). Various methods may be used to form the phosphor resin portions 13 simultaneously. Examples of those methods include a screen process printing method, an intaglio printing method, a transfer method and a dispenser method.

Hereinafter, a method of making the phosphor resin portions 13 will be described with reference to FIGS. 23 through 27.

Figure 23:
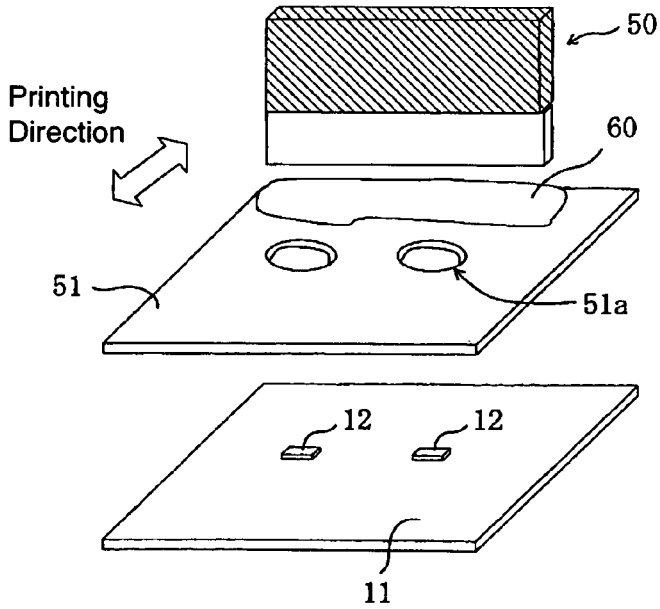
FIG. 23 is a perspective view showing the process step of forming multiple phosphor resin portions 13 by a screen process printing technique.

FIG. 23 shows the process step of forming the phosphor resin portions 13 by the screen process printing technique. First, a substrate 11 on which multiple LED chips 12 are arranged is prepared. FIG. 23 shows only two LED chips 12 to make this method easily understandable. Actually, however, a substrate 11 on which a number of LED chips 12 are arranged two-dimensionally (e.g., in matrix, substantially concentrically or spirally) should be prepared to fabricate the LED lamp 100 of this preferred embodiment.

Next, a printing plate 51, having a plurality of openings (or through holes) 51*a* in the same size as that of the phosphor resin portions 13 (13*a* and 13*b*) to be obtained, is placed over the substrate 11 such that the LED chips 12 are located within the openings 51*a*. Then, the printing plate 51 and the substrate 11 are brought into close contact with each other. Thereafter, a squeeze 50 is moved in a printing direction, thereby filling the openings 51*a* with a resin paste 60 on the printing plate 51 and covering the LED chips 12 with the resin paste 60. When the printing process is finished, the printing plate 51 is removed. The phosphor is dispersed in the resin paste 60. Accordingly, when the resin paste 60 is cured, the phosphor resin portions 13 can be obtained. If the volume of the outer phosphor resin portions 13 should be greater than that of the inner phosphor resin portions 13, then the openings 51*a* for the outer LED chips 12 preferably have an increased size. As for the other methods to be described below, the same process step as this process step of the screen process printing method will not be described again but the description will be focused on only their unique process steps.

Figure 24:
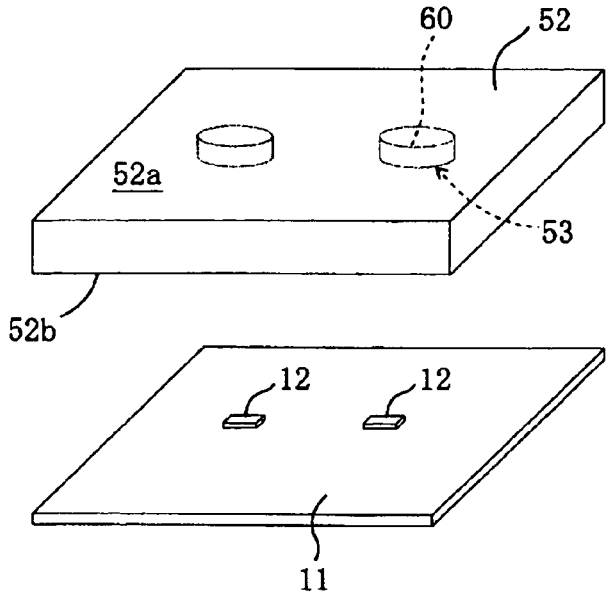
FIG. 24 is a perspective view showing the process step of forming multiple phosphor resin portions 13 by an intaglio printing technique.
Figure 25A:
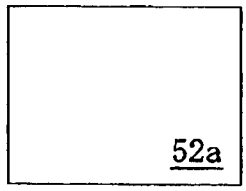
FIGS. 25A and 25B are plan views showing the upper and lower surfaces 52*a* and 52*b* of the block 52 for use in the intaglio printing process.
Figure 25B:
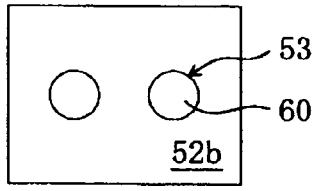

FIG. 24 shows the process step of forming the phosphor resin portions 13 by the intaglio printing method. FIGS. 25A and 25B respectively show the upper surface 52*a* and lower surface 52*b* of a printing plate 52 for use in this intaglio printing process. When the intaglio printing method is adopted, the printing plate 52 shown in FIGS. 25A and 25B, having recesses 53 (i.e., not reaching the upper surface 52*a*) on the lower surface 52*b*, is prepared and those recesses 53 are filled with a resin paste 60. Then, as shown in FIG. 24, the printing plate 52 is placed over the substrate 11 on which the LED chips 12 are arranged and the printing plate 52 and the substrate 11 are brought into close contact with each other. Thereafter, by removing the printing plate 52, the phosphor resin portions 13 can be obtained. If the volume of the outer phosphor resin portions 13 should be greater than that of the inner phosphor resin portions 13, then the recesses 53 for the outer LED chips 12 preferably have an increased size. That is to say, the recesses 53 may be classified into a group with a relatively large volume and a group with a relatively small volume.

Figure 26:
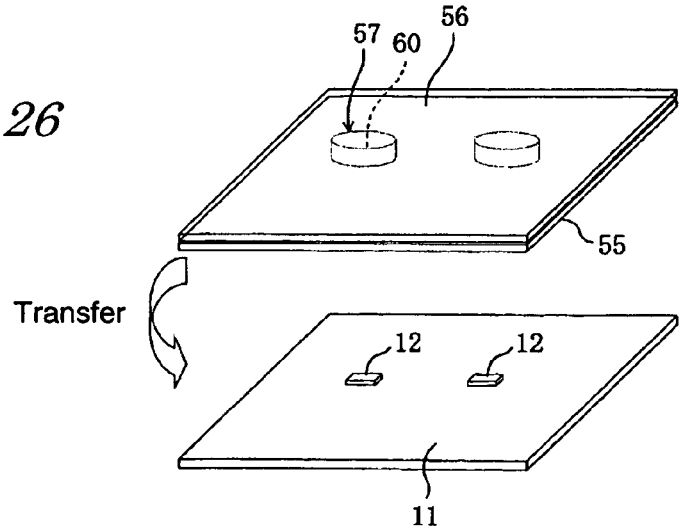
FIG. 26 is a perspective view showing the process step of forming multiple phosphor resin portions 13 by a transfer (planographic) technique.

FIG. 26 shows the process step of forming the phosphor resin portions 13 by the transfer (planographic) method. According to this method, a photosensitive resin film 56 is deposited on a block 55, a plurality of openings 57, corresponding in shape to the phosphor resin portions 13 to be obtained, are provided using a resist, and then those openings 57 are filled with a resin paste 60. Thereafter, the block 55 is pressed against the substrate 11, thereby transferring the resin paste 60 onto the substrate 11. In this manner, the phosphor resin portions 13 are formed so as to cover the LED chips 12. If the volume of the outer phosphor resin portions 13 should be greater than that of the inner phosphor resin portions 13, then the openings 57 for the outer LED chips 12 preferably have an increased size. Also, if the concentration of the phosphor in the outer phosphor resin portions 13 should be higher than that of the phosphor in the inner phosphor resin portions 13, then a resin paste 60 with a relatively high phosphor concentration may be injected into the openings 57 for the outer LED chips 12.

Figure 27:
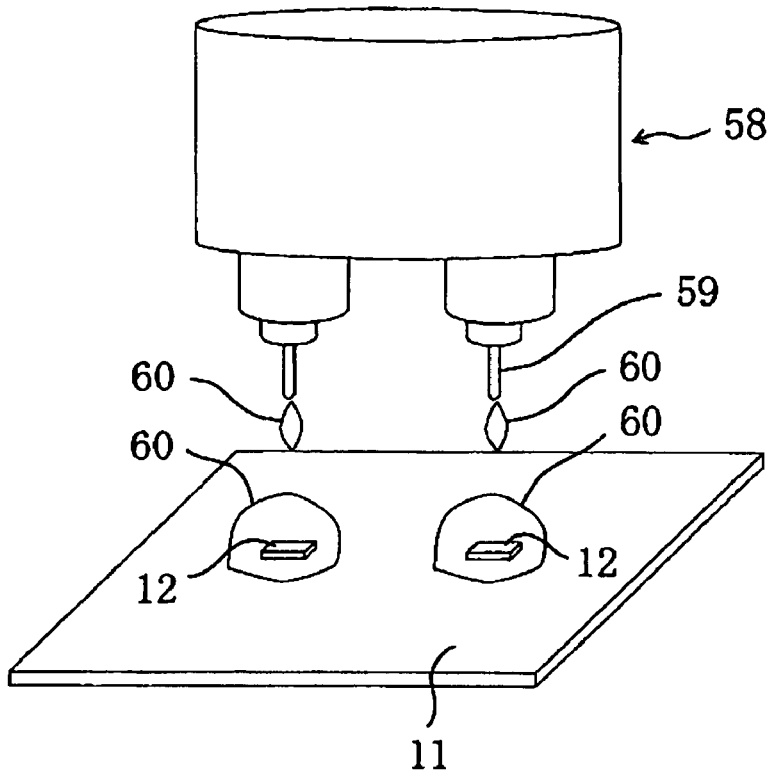
FIG. 27 is a perspective view showing the process step of forming multiple phosphor resin portions 13 by a dispenser method.

FIG. 27 shows the process step of forming the phosphor resin portions 13 by the dispenser method. According to this method, the phosphor resin portions 13 are formed by spraying a predetermined amount of resin paste 60 over the LED chips 12 on the substrate 11 using a dispenser 58 including syringes 59 to spray the resin paste 60. If a greater amount of resin paste 60 is sprayed for the outer phosphor resin portions 13*b* than for the inner phosphor resin portions 13*a*, then the size, volume and the phosphor concentration of the outer phosphor resin portions 13*b* can be all increased.

Optionally, the configuration of the phosphor resin portions 13 described above and the lens structures shown in FIGS. 22A and 22B may be used in combination. It depends on the specific intended application whether those configurations are combined or not and exactly what configurations should be combined together.

Figure 28A:
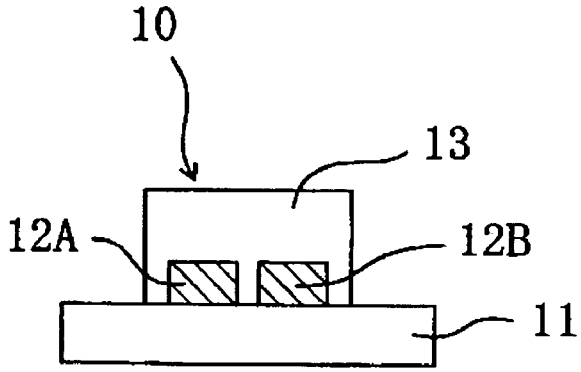
FIGS. 28A and 28B are respectively a side cross-sectional view and a plan view illustrating a configuration in which two LED bare chips 12A and 12B are arranged within a single phosphor resin portion 13.
Figure 28B:
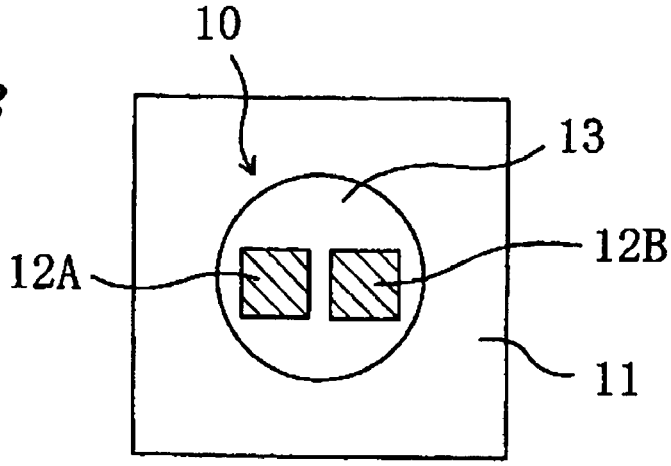

In the first and second preferred embodiments described above, one LED bare chip 12 is provided within one phosphor resin portion 13. However, the present invention is in no way limited to those specific preferred embodiments. If necessary, two or more LED bare chips 12 may be provided within a single phosphor resin portion 13. FIGS. 28A and 28B illustrate such an alternative arrangement in which two LED bare chips 12A and 12B are provided within one phosphor resin portion 13. In this case, the LED bare chips 12A and 12B may emit either light rays falling within the same wavelength range or light rays falling within mutually different wavelength ranges. For example, the LED bare chip 12A may be a blue LED chip and the LED bare chip 12B may be a red LED chip. Then, the two or more LED bare chips 12 (e.g., 12A and 12B in this example) that are covered with the same phosphor resin portion 13 have a peak wavelength of 380 nm to 470 nm (e.g., a wavelength of 460 nm if there is provided only one LED bare chip 12A of one type) and a peak wavelength of 610 nm to 650 nm (e.g., a wavelength of 620 nm if there is provided only one LED bare chip 12B of another type). That is to say, the peak wavelengths of the at least two LED bare chips 12 all fall within the visible range of 380 nm to 780 nm. When the blue LED chip 12A and red LED chip 12B are both used, a white LED lamp, of which the color rendering performance is excellent in red colors, can be obtained. More specifically, if a blue LED chip and a yellow phosphor are combined, white can be produced but that white is somewhat short of red components. Consequently, the resultant white LED lamp exhibits insufficient color rendering performance in red colors. However, if the red LED chip 12B is combined with the blue LED chip 12A, then the color rendering performance of the white LED lamp in red colors can be improved. As a result, an LED lamp that can be used even more effectively as general illumination is realized.

The present invention has been described by way of illustrative preferred embodiments. However, the present invention is in no way limited to those specific preferred embodiments but may be modified in various manners. For example, in the configurations shown in FIGS. 12 and 13, the LEDs 10 may also be connected in parallel to each other.

It should be noted that the first interconnection pattern for electrically connecting together the LEDs 10 located around the outer periphery and the second interconnection pattern for electrically connecting together the other LEDs 10 located elsewhere are not limited to those shown in FIGS. 12 and 13. Hereinafter, this respect will be described in detail.

FIGS. 29A through 29D illustrate alternative interconnection structures for LED lamps according to other preferred embodiments of the present invention. In FIGS. 29A through 29D, the solid circles ● represent LEDs to be connected to one interconnection pattern and the open circles ○ represent LEDs to be connected to another interconnection pattern.

Figure 29A:
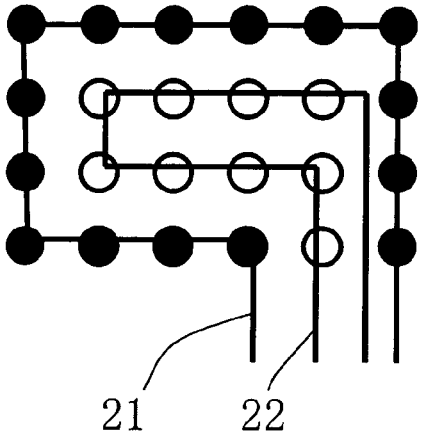
FIGS. 29A through 29D illustrate exemplary interconnection structures for LED lamps according to alternative preferred embodiments of the present invention.
Figure 29B:
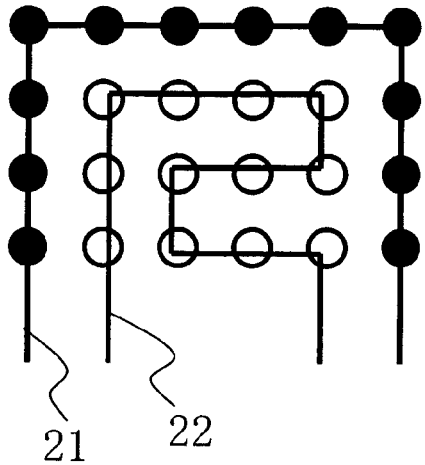

In the example illustrated in FIG. 29A, fifteen out of the sixteen LEDs around the outer periphery are connected to the first interconnection pattern 21 but the other LED is connected to the second interconnection pattern 22. On the other hand, in the example illustrated in FIG. 29B, twelve out of the sixteen LEDs around the outer periphery are connected to the first interconnection pattern 21 but the other four LEDs are connected to the second interconnection pattern 22. In this manner, not all of the outer LEDs have to be connected to the same interconnection pattern.

Figure 29C:
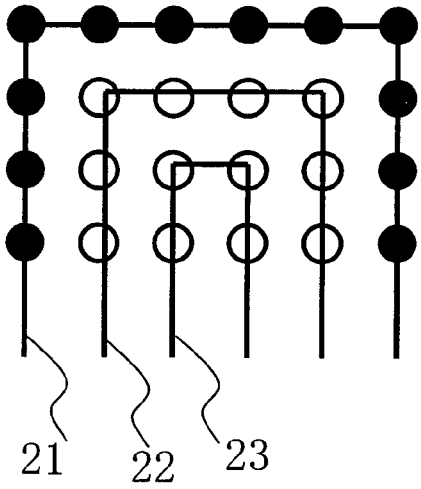

FIG. 29C shows a situation where the interconnection structure has three interconnection patterns 21, 22 and 23. Thus, the number of the interconnection patterns that a single LED lamp has is not always two but may be three or more.

Figure 29D:
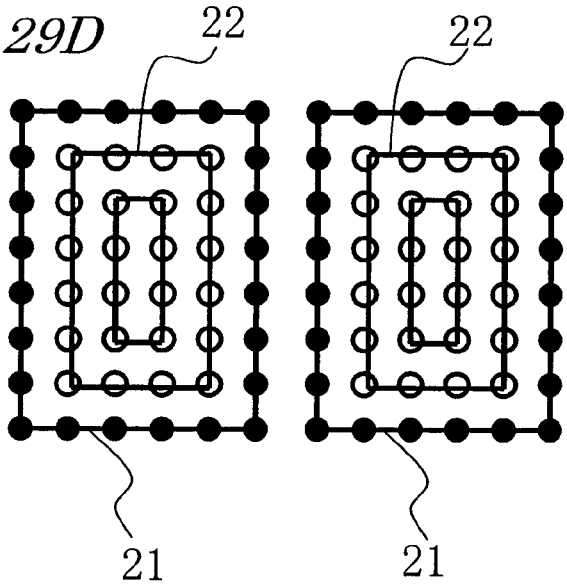

In the example illustrated in FIG. 29D, two clusters of LEDs are arranged within a single LED lamp. In this case, the LEDs located in the outside portion of each LED cluster are connected to the first interconnection pattern 21, while the LEDs located in the inside portion thereof are connected to the second interconnection pattern 22. If these two LED clusters are provided sufficiently close to each other, these two clusters function as one cluster of LEDs. However, if the gap between these two LED clusters exceeds 4 mm, for example, the interconnection structure, which can control the amount of the light emitted from the outer LEDs of each cluster, may be adopted as shown in FIG. 29D.

In the example illustrated in FIG. 29D, the first interconnection pattern 21 for the LED cluster on the left-hand side and the first interconnection pattern 21 for the LED cluster on the right-hand side are preferably connected together by way of a lower-level interconnect (not shown). In the same way, the second interconnection pattern 22 for the LED cluster on the left-hand side and the second interconnection pattern 22 for the LED cluster on the right-hand side are preferably connected together by way of another lower-level interconnect (not shown). Accordingly, the amounts of light emitted from the LEDs in the right and left LED clusters can be controlled in the same way. Alternatively, if a number of LED clusters are included in a single LED lamp, the amounts of light emitted from the LEDs in those clusters may also be controlled independently of each other.

Various preferred embodiments of the present invention described above provide an LED lamp that can reduce the glare significantly, and therefore, contribute to further popularizing LED lamps as general illumination.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Applications No. 2003-322645 filed Sep. 16, 2003 and No. 2004-259304 filed Sep. 7, 2004, the entire contents of which are hereby incorporated by reference.

What is claimed is:

1. A light emitting diode (LED) lamp comprising:

a substrate;

a cluster of LEDs, which are arranged two-dimensionally on the substrate; and an interconnection circuit, which is electrically connected to the LEDs, wherein the LEDs include a first group of LEDs, which are located around the outer periphery of the cluster, and a second group of LEDs, which are located elsewhere in the cluster, wherein the interconnection circuit has an interconnection structure for separately supplying drive currents to at least one of the LEDs in the first group and to at least one of the LEDs in the second group separately from each other, wherein each said LED includes a lens for controlling the spatial distribution of the emission of the LED, and wherein the lens of the LEDs in the second group has a structure that realizes a narrower spatial distribution than the lens of the LEDs in the first group.

2. The light emitting diode (LED) lamp of claim 1, wherein all of the LEDs in the first group are located outside of the second group of LEDs.

3. The light emitting diode (LED) lamp of claim 1, wherein the interconnection circuit has a first interconnection pattern for electrically connecting together at least two of the LEDs in the first group and a second interconnection pattern for electrically connecting together at least two of the LEDs in the second group.

4. The light emitting diode (LED) lamp of claim 3, wherein the interconnection circuit is electrically connected to a dimmer, and wherein the dimmer has the function of controlling the amounts of light emitted from the first and second groups of LEDs, which are electrically connected to the first and second interconnection patterns, respectively, independently of each other.

5. The light emitting diode (LED) lamp of claim 3, wherein the first interconnection pattern of the interconnection circuit is electrically connected to a dimmer, and wherein the dimmer has the function of controlling the amount of light emitted from the first group of LEDs, which are electrically connected to the first interconnection pattern.

6. The light emitting diode (LED) lamp of claim 3, further comprising a resistor, which is connected to at least one of the first and second interconnection patterns, wherein the resistor reduces a difference between the amounts of currents flowing through the first and second interconnection patterns.

7. The light emitting diode (LED) lamp of claim 1, wherein each said LED includes an LED bare chip and a phosphor resin portion that covers the LED bare chip, and wherein the phosphor resin portion includes: a phosphor for transforming the emission of the LED bare chip into light having a longer wavelength than the emission; and a resin in which the phosphor is dispersed.

8. The light emitting diode (LED) lamp of claim 1, wherein the outer periphery is defined along the outermost ones of the LEDs in the first group.

9. A light emitting diode (LED) lamp comprising:

a substrate;

a cluster of LEDs, which are arranged two-dimensionally on the substrate; and an interconnection circuit, which is electrically connected to the LEDs, wherein the LEDs include a first group of LEDs, which are located around the outer periphery of the cluster, and a second group of LEDs, which are located elsewhere in the cluster, wherein the interconnection circuit has an interconnection structure for separately supplying drive currents to at least one of the LEDs in the first group and to at least one of the LEDs in the second group separately from each other, wherein the emission of the LEDs in the first group has a lower color temperature than that of the LEDs in the second group.

10. The light emitting diode (LED) lamp of claim 9, wherein all of the LEDs in the first group are located outside of the second group of LEDs.

11. The light emitting diode (LED) lamp of claim 9, wherein the interconnection circuit has a first interconnection pattern for electrically connecting together at least two of the LEDs in the first group and a second interconnection pattern for electrically connecting together at least two of the LEDs in the second group.

12. The light emitting diode (LED) lamp of claim 11, wherein the interconnection circuit is electrically connected to a dimmer, and wherein the dimmer has the function of controlling the amounts of light emitted from the first and second groups of LEDs, which are electrically connected to the first and second interconnection patterns, respectively, independently of each other.

13. The light emitting diode (LED) lamp of claim 11, wherein the first interconnection pattern of the interconnection circuit is electrically connected to a dimmer, and wherein the dimmer has the function of controlling the amount of light emitted from the first group of LEDs, which are electrically connected to the first interconnection pattern.

14. The light emitting diode (LED) lamp of claim 11, further comprising a resistor, which is connected to at least one of the first and second interconnection patterns, wherein the resistor reduces a difference between the amounts of currents flowing through the first and second interconnection patterns.

15. The light emitting diode (LED) lamp of claim 9, wherein each said LED includes an LED bare chip and a phosphor resin portion that covers the LED bare chip, and wherein the phosphor resin portion includes: a phosphor for transforming the emission of the LED bare chip into light having a longer wavelength than the emission; and a resin in which the phosphor is dispersed.

16. The light emitting diode (LED) lamp of claim 9, wherein the outer periphery is defined along the outermost ones of the LEDs in the first group.

* * * * *